US006506084B2

(12) United States Patent
Saitoh

(10) Patent No.: US 6,506,084 B2
(45) Date of Patent: Jan. 14, 2003

(54) TERMINAL STRUCTURE OF CONNECTOR

(75) Inventor: Yasushi Saitoh, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/073,155

(22) Filed: Feb. 13, 2002

(65) Prior Publication Data

US 2002/0155763 A1 Oct. 24, 2002

(30) Foreign Application Priority Data

Feb. 15, 2001 (JP) ..... 2001-038876

(51) Int. Cl.[7] ..... H01R 11/22
(52) U.S. Cl. ..... 439/852; 439/843; 439/845
(58) Field of Search ..... 439/839–862

(56) References Cited

U.S. PATENT DOCUMENTS 4,631,824 A * 12/1986 King ..... 439/842
5,980,336 A * 11/1999 Hall et al. ..... 439/843
6,386,928 B2 * 5/2002 Kitamura ..... 439/852

FOREIGN PATENT DOCUMENTS

EP 1 107 376 A2 6/2001
JP U 4-94275 8/1992

* cited by examiner

*Primary Examiner*—P. Austin Bradley
*Assistant Examiner*—Briggitte R. Hammond
(74) *Attorney, Agent, or Firm*—Oliff & Berridge, PLC

(57) ABSTRACT

A terminal structure of a connector includes a female terminal having a spring contact in a fitting portion thereof, and a male terminal having a male tab to be inserted into the fitting portion of the female terminal and contacted by the spring contact. When the male tab is fitted into the fitting portion of the female terminal to connect the male and female terminals together, during the interval between a point of initial contact between the male tab and the spring contact and a point just before the insertion force of the male tab reaches its peak value, the contact angle δL of the male tab with respect to the spring contact, and the friction coefficient $\mu$ between a surface of the male tab and a surface of the spring contact satisfy the following relational expression:

$$90° > \delta L \geq 90° - \tan^{-1}[(3-5\mu)/(5+3\mu)].$$

9 Claims, 7 Drawing Sheets

TERMINAL STRUCTURE OF CONNECTOR

BACKGROUND OF THE INVENTION

1. Field of Invention

The present invention relates to a terminal structure of a connector including a female terminal having a tongue-piece-shaped spring contact disposed in a fitting portion thereof and a male terminal to be inserted into the fitting portion of the female terminal to contact with the spring contact.

2. Description of Related Art

Hitherto, when connecting together wire harnesses for a car, there is used a connector including a female terminal having a tongue-piece-shaped spring contact disposed in a fitting portion thereof and a male terminal having a male tab to be inserted into the fitting portion of the female terminal to contact with the spring contact; that is, by connecting together the male and female terminals, the wire harnesses can be electrically connected to each other.

For example, as shown in FIG. 9, in a fitting portion 1 of a female terminal 2 into which a male tab 3 of a male terminal 4 can be fitted, there are disposed a fixed contact 5, which can contact with one surface of the male tab 3, and a spring contact 6*a*, opposed to the fixed contact 5 with a given initial clearance. The male tab 3 is inserted between the two contacts 5, 6*a* and deforms the spring contact 6*a* elastically. While the spring contact 6*a* is elastically deformed in this manner, the male tab 3 contacts the two contacts 5, 6*a* to electrically connect a harness fixed to the female terminal 2 to a harness fixed to the male terminal 4.

In the above-mentioned structure, the initial clearance formed between the two contacts 5, 6*a* of the female terminal 2 is set at a value smaller by a given amount than the thickness of the male tab 3. Therefore, as the male tab 3 of the male terminal 4 is inserted into between the two contacts 5, 6*a*, the spring contact 6*a* is greatly deformed elastically to rapidly increase its contact reaction force. At the same time, as shown by a broken line in FIG. 7, just after the male tab 3 is inserted, the insertion force Fa of the male terminal 4 with respect to the female terminal 2 rises suddenly up to its peak value. Thereafter, the insertion force Fa decreases by a given amount, thereby bringing the two terminals 2, 4 into a connection-completed state.

Also, after the insertion of the male tab 3, as the insertion force Fa rises, the contact reaction force PLa of the spring contact 6*a* rises, as shown by another broken line in FIG. 7. Therefore, when the contact reaction force PLa of the spring contact 6*a* in the connection-completed state of the two terminals 2, 4 is set at a given value to thereby secure a contact pressure between the male tab 3 and spring contact 6*a*, the peak value of the insertion force Fa is inevitably caused to increase, which requires a large operation force when connecting together the two terminals 2, 4.

There has been a tendency, especially recently, that, as electronic equipment to be mounted in a car has been increasing in number, the number of terminals in connectors has been increasing. To cope with this trend, it is required that the arrangement pitch of the terminals is narrowed to thereby reduce the size of the connector, and that the insertion force per terminal is reduced to enhance the operation efficiency in connecting together the terminals. However, from the viewpoint of maintenance of the connection reliability of the connector, as described above, it is necessary that the contact reaction force of the spring contact is maintained at a given value. Therefore, it is difficult to further reduce the connecting operation force of the two terminals. This is a problem.

SUMMARY OF THE INVENTION

The present invention aims at eliminating the above-described problems. Accordingly, it is an object of the invention to provide a terminal structure of a connector which can reduce effectively the insertion force of a male tab with respect to the fitting portion of a female terminal without impairing the connection reliability of the connector.

According to a first aspect of the invention, there is provided a terminal structure of a connector including a female terminal, having a spring contact, e.g., a tongue-piece-shaped spring contact, in a fitting portion thereof, and a male terminal, having a male tab to be inserted into the fitting portion of the female terminal and contacted by the spring contact. When the male tab is fitted into the fitting portion of the female terminal, during the interval between a point of initial contact between the male tab and the spring contact and a point just before the insertion force of the male tab reaches its peak value, the contact angle δL of the male tab with respect to the spring contact, and the friction coefficient $\mu$ between a surface of the male tab and a surface of the spring contact satisfy the following relational expression:

$$90° > \delta L \geqq 90° - \tan_{-1}[(3-5\mu)/(5+3\mu)].$$

According to the above structure, when the male tab is fitted into the fitting portion of the female terminal to connect together the male and female terminals, the contact reaction force of the spring contact can be set at a sufficiently high value, while preventing the insertion force of the male tab from suddenly increasing up to its peak value.

According to a second aspect of the invention, there is provided the terminal structure of the connector according to the first aspect of the invention, wherein during the interval between a point of initial contact between the male tab and the spring contact and a point just before the insertion force of the male tab reaches its peak value, the contact angle δL of the male tab with respect to the spring contact, and the friction coefficient $\mu$ between the surface of the male tab and the surface of the spring contact satisfy the following relational expression:

$$90° > \delta L \geqq 90° - \tan_{-1}[(1-2\mu)/(2+\mu)].$$

According to the above structure, when the male tab is fitted into the fitting portion of the female terminal to connect the male and female terminals together, the peak value of the insertion force of the male tab can be reduced more effectively and also the contact reaction force of the spring contact can be set at a sufficiently high value.

According to a third aspect of the invention, there is provided the terminal structure of the connector according to the first aspect of the invention, wherein during the interval between a point of initial contact between the male tab and the spring contact and a point just before the insertion force of the male tab reaches its peak value, the contact angle δL of the male tab with respect to the spring contact, and the friction coefficient $\mu$ between the surface of the male tab and the surface of the spring contact satisfy the following relational expression:

$$90° > \delta L \geqq 53.74° \times \mu + 59.537°.$$

According to this structure, when the friction coefficient between the surface of the male tab and the surface of the spring contact is in a range of from about 0.1 to about 0.4, the peak value of the insertion force, which is generated when the male tab is fitted into the fitting portion of the female terminal to connect the male and female terminals together, can be kept down to about 60% or less of the contact reaction force of the spring contact in the connection-completed state of the terminals.

According to a fourth aspect of the invention, there is provided the terminal structure of the connector according to the second aspect of the invention, wherein during the interval between a point of initial contact between the male tab and the spring contact and a point just before the insertion force of the male tab reaches its peak value, the contact angle δL of the male tab with respect to the spring contact, and the friction coefficient $\mu$ between the surface of the male tab and the surface of the spring contact satisfy the following relational expression:

$$90° > \delta L \geqq 53.74° \times \mu + 63.936°.$$

According to the above structure, when the friction coefficient between the surface of the male tab and the surface of the spring contact is in a range of from about 0.1 to about 0.4, the peak value of the insertion force, which is generated when the male tab is fitted into the fitting portion of the female terminal to connect the male and female terminals together, can be kept down to about 50% or less of the contact reaction force of the spring contact in the connection-completed state of the terminals.

According to a fifth aspect of the invention, there is provided the terminal structure of the connector according to the first aspect of the invention, wherein during the interval between a point of initial contact between the male tab and the spring contact and a point just before the insertion force of the male tab reaches its peak value, the contact angle δL of the male tab with respect to the spring contact is in a range of:

$$90° > \delta L \geqq 67.5°.$$

According to this structure, when the friction coefficient between the surface of the male tab and the surface of the spring contact is about 0.15, the peak value of the insertion force, which is generated when the male tab is fitted into the fitting portion of the female terminal to connect together the male and female terminals, can be kept down to about 60% or less of the contact reaction force of the spring contact in the connection-completed state of the terminals.

According to a sixth aspect of the invention, there is provided the terminal structure of the connector according to the second aspect of the invention, wherein during the interval between a point of initial contact between the male tab and the spring contact and a point just before the insertion force of the male tab reaches its peak value, the contact angle δL of the male tab with respect to the spring contact is in a range of:

$$90° > \delta L \geqq 71.9°.$$

According to this structure, when the friction coefficient between the surface of the male tab and the surface of the spring contact is about 0.15, the peak value of the insertion force, which is generated when the male tab is fitted into the fitting portion of the female terminal to connect together the male and female terminals, can be kept down to about 50% or less of the contact reaction force of the spring contact in the connection-completed state of the terminals.

According to a seventh aspect of the invention, there is provided the terminal structure of the connector according to any one of the first to sixth aspects of the invention, wherein a forwardly-tapered inclined surface is formed at a leading end portion of the male tab. When the male tab is fitted into the fitting portion of the female terminal, a base end portion of the inclined surface contacts the spring contact.

According to the above structure, when the male tab is fitted into the fitting portion of the female terminal, the base end portion of the inclined surface contacts the spring contact. Therefore, the contact angle of the male tab is not decided in accordance with the inclination angle of the inclined surface. The contact angle δL of the male tab with respect to the spring contact of the female terminal can be set at a proper value, regardless of the inclination angle of the inclined surface.

These and other objects, advantages and salient features are described in or are apparent from the following detailed description of exemplary embodiments.

BRIEF DESCRIPTION OF THE DRAWINGS

Exemplary embodiments are described below based on the drawings, in which like numerals represent like parts, and wherein.

DETAILED DESCRIPTION OF PREFERRED EMBODIMENTS

Figure 1:
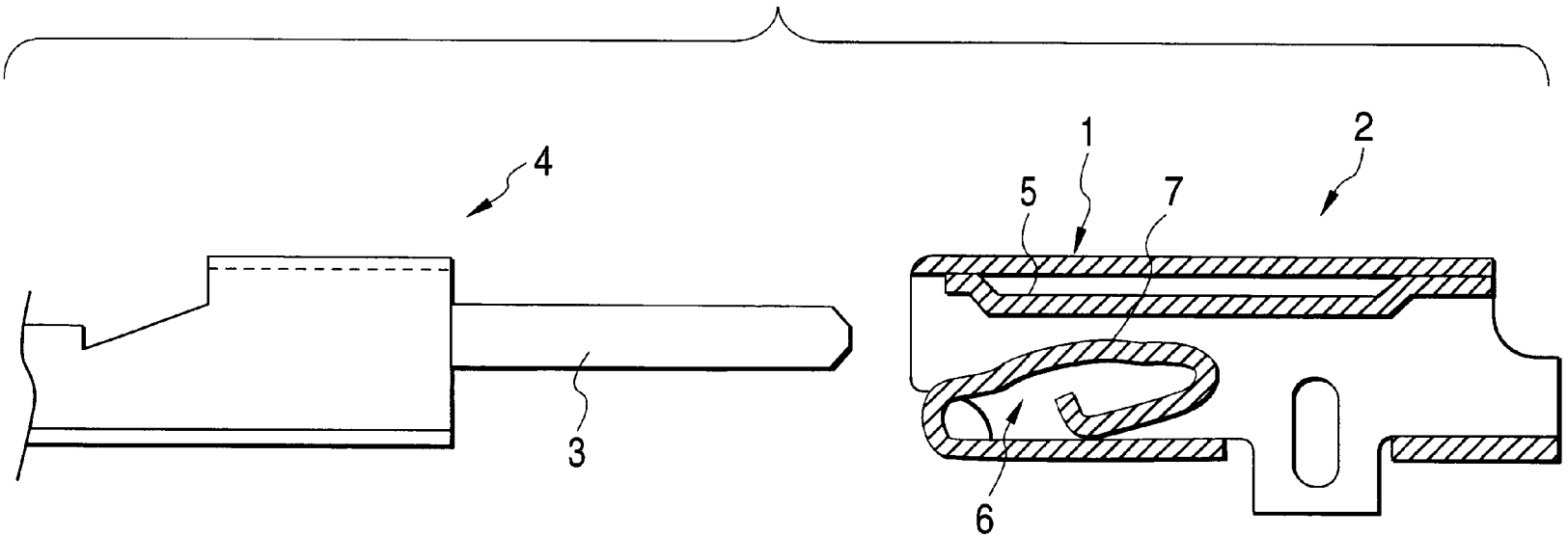
FIG. 1 is a side section view of an embodiment of a terminal structure of a connector according to the invention.
Figure 2:
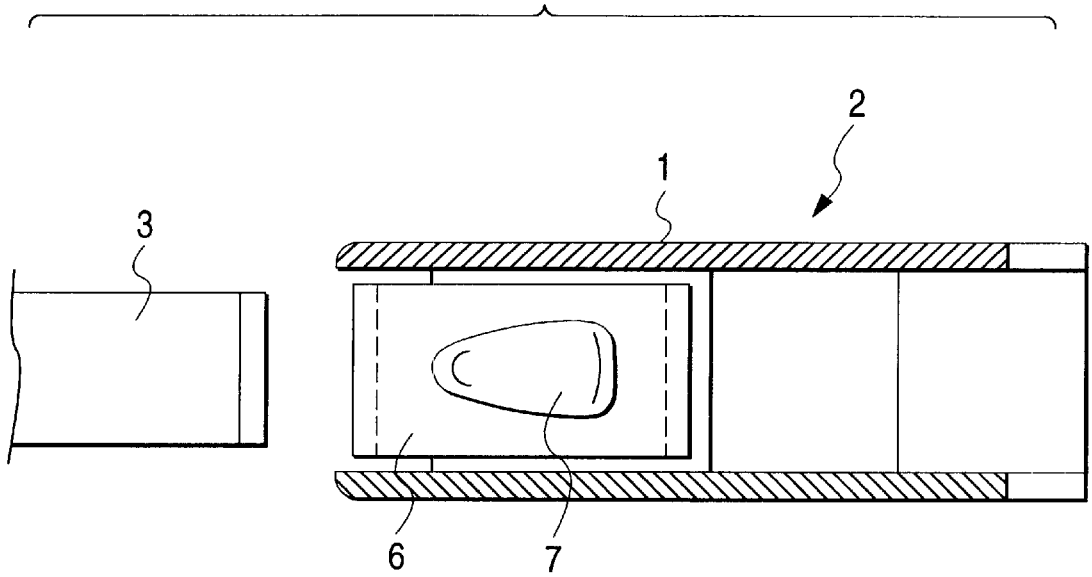
FIG. 2 is a plan section view of the terminal structure of the connector of FIG. 1.

FIGS. 1 and 2 show an embodiment of a terminal structure of a connector according to the invention. This connector includes a female terminal 2 having a fitting portion 1, which may have a cylindrical shape or other suitable shape, and a male terminal 4 including a male tab 3 to be inserted into the fitting portion 1 of the female terminal 2. By inserting the male tab 3 of the male terminal 4 into the fitting portion 1 of the female terminal 2, a harness (not shown) fixed to a rear end portion of the female terminal 2 can be electrically connected to a harness (not shown) fixed to a rear end portion of the male terminal 4.

In the interior of the fitting portion 1 of the female terminal 2, there is a spring contact 6 situated upwardly of a bottom wall portion of the fitting portion 1. There may also be a fixed contact 5 mounted on a lower surface of a ceiling portion of the fitting portion 1, opposed to the spring contact 6 with a given initial clearance therebetween. The spring contact 6 is preferably formed by, for example, bending or folding upwardly a plate-shaped member which is disposed on and extended continuously from a front end of the bottom wall portion of the fitting portion 1. On an upper surface of the spring contact 6, there is formed a contact portion 7 which swells out toward the fixed contact 5.

The inclination angle of the spring contact 6 with respect to a longitudinal axis of the female terminal 2 is set smaller than that of the spring contact employed in the related art. The contact portion 7 swells out upwardly over a given range of the spring contact 6, from the vicinity of the front end portion of the spring contact 6 to the vicinity of the rear end portion thereof, in a gentle curve. Due to this swelled contact portion 7, when the male tab 3 is inserted into the fitting portion 1 of the female terminal 2 to connect the two terminals 2, 4 together, during the interval between a point of initial contact between the male tab and the spring contact and a point just before the insertion force of the male tab reaches its peak value, the contact angle δL of the male tab 3 with respect to the spring contact 6, and the friction coefficient $\mu$ between a surface of the male tab 3 and a surface of the spring contact 6 satisfy the following relational expression:

$$90°>\delta L\geqq 90°-\tan_{-1}[(3-5\mu)/(5+3\mu)].$$

Figure 3:
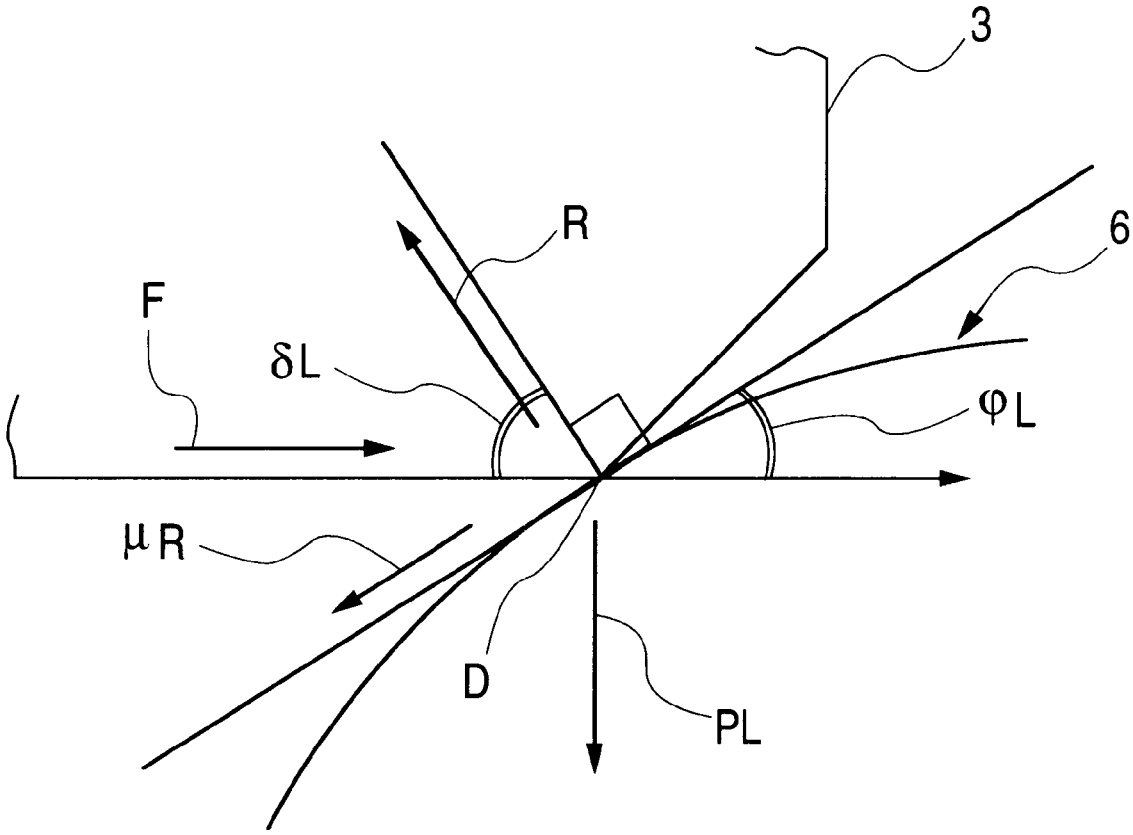
FIG. 3 is an explanatory view of acting states of stresses when a male tab of a male terminal is inserted.

That is, as shown in FIG. 3, when the male tab 3 of the male terminal 4 is inserted into the fitting portion 1 of the female terminal 2 to apply a given insertion force F between the two terminals 2, 4, between the male tab 3 and spring contact 6, there are generated a vertical drag R (a reaction force applied in the normal direction of the spring contact 6 to push back the male tab 3) corresponding to the insertion force F, a friction force $\mu$R applied in the tangential direction of the spring contact 6 in correspondence to the vertical drag R, and a contact reaction force PL to push down the contact spring 6. Among these forces, the following balance equations (1), (2) can be obtained:

$$F=\mu\cdot R\cdot\cos\phi L+R\cdot\sin\phi L \quad (1)$$

$$R\cdot\cos\phi L=PL+\mu\cdot R\cdot\sin\phi L \quad (2)$$

It is noted that in the above equations (1), (2), ϕL expresses the inclination angle of the spring contact 6, with respect to a longitudinal axis (i.e., axis of insertion) of the female terminal 2, at the contact point of the male tab 3. That is, ϕL expresses the angle formed between the insertion direction of the male tab 3 and the above-mentioned tangential direction. Between the inclination angle ϕL, and the contact angle ϕL of the contact spring 6 with respect to the male tab 3 that is defined between the insertion direction of the male tab 3 and the above-mentioned normal direction, there can be obtained the following relational expression (3):

$$\delta L=90°-\delta L \quad (3)$$

When the vertical drag R is eliminated from the above balance equations (1), (2), the following relational expression (4) can be obtained:

$$F=[(\mu+\tan\phi L)/(1-\mu\cdot\tan\phi L)]PL \quad (4)$$

This relational expression (4) shows that, when the contact reaction force PL is the same, the insertion force F of the male tab 3 with respect to the female terminal 2 varies depending on the friction coefficient $\mu$ and inclination angle δL.

To reduce the insertion force F of the male tab 3, in order to avoid fatiguing an operator, and to keep the contact reaction force PL at a sufficient value to ensure the connection reliability of the connector, the present inventors conducted various tests. According to the tests, it was confirmed that, when the following conditional expression (5) was satisfied between the insertion force F and the contact reaction force PL, the connection reliability of the connector could be ensured without fatiguing the operator:

$$0<F\leqq 0.6PL \quad (5)$$

From the expressions (4) and (5), the following relational expression (6) can be obtained:

$$0<(\mu+\tan\phi L)/(1-\mu\cdot\tan\phi L)\leqq 0.6 \quad (6)$$

If the expression (6) is transformed, then the following expression (7) can be obtained:

$$0<\tan\phi L\leqq(3-5\mu)/(5+3\mu) \quad (7)$$

If the value of expression (3) (δL=90°−ϕL) is substituted for ϕL in the expression (7) and the expression (7) is transformed, then the following relational expression (8) can be obtained:

$$90°>\delta L\geqq 90°-\tan_{-1}[(3-5\mu)/(5+3\mu)] \quad (8)$$

Accordingly, the two terminals are structured such that, when the male tab 3 of the male terminal 4 is inserted into the fitting portion 1 of the female terminal 2 to connect together the two terminals 2, 4, during the interval between a point of initial contact between the male tab and the spring contact and a point just before the insertion force of the male tab reaches its peak value, the contact angle δL of the male tab 3 with respect to the spring contact 6, and the friction coefficient $\mu$ between the surface of the male tab 3 and the surface of the spring contact 6 satisfy the relational expression (8), that is, the relationship, $90°>\delta L\geqq 90°-\tan^{-1}[(3-5\mu)/(5+3\mu)]$. With this structure, the insertion force F can be kept down to 60% or less of the contact reaction force PL, and thus the connection reliability of the connector can be ensured without imposing any extra burden on the operator.

Generally, when the female terminal 2 and male terminal 4 are each made of metal members or metal members having their surfaces plated, since the friction coefficient $\mu$ is in a range of from about 0.1 to about 0.4, the lower limit values of the contact angles δL existing in this range can be calculated in accordance with the relational expression (8). When the resultant values are shown in a graphic form, they can be expressed by a line A shown in FIG. 4.

Figure 4:
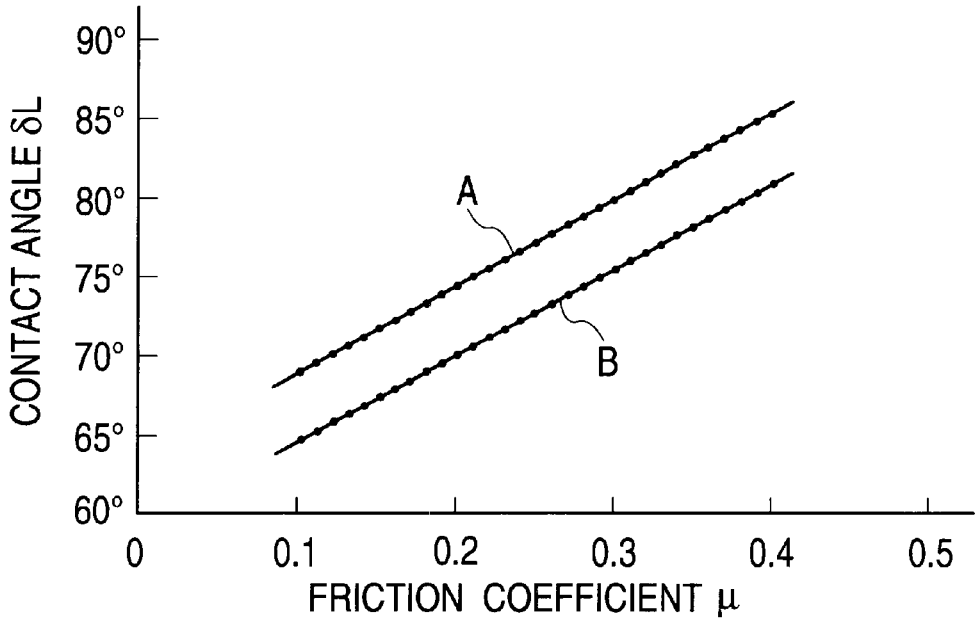
FIG. 4 is a graphical representation of a correspondence between friction coefficients and contact angles.

The graphical representation of FIG. 4 shows that, when the male tab 3 of the male terminal 4 is inserted into the fitting portion 1 of the female terminal 2 to connect the two terminals 2, 4 together, in a case in which, during the interval between a point of initial contact between the male tab and the spring contact and a point just before the insertion force of the male tab reaches its peak value, the contact angle δL of the male tab 3 with respect to the spring contact 6, and the friction coefficient $\mu$ between the surface of the male tab 3 and the surface of the spring contact 6 meet the following expression (9), the connection reliability of the connector can be ensured without imposing any extra burden on the operator.

$$90°>\delta L\geqq 53.74\mu+59.537° \quad (9)$$

Also, when the friction coefficient $\mu$ is measured in actual terminal materials, the measured value is often found to be 0.15 or more. Therefore, the following relational expression (10) can be obtained from the above expression (9). Thus, when the male tab 3 of the male terminal 4 is inserted into the fitting portion 1 of the female terminal 2 to connect the two terminals 2, 4 together, in a case in which, during the interval between a point of initial contact between the male tab and the spring contact and a point just before the insertion force of the male tab reaches its peak value, the contact angle δL of the male tab 3 with respect to the spring contact 6 is set so as to be 67.5° or more, the insertion force F can be kept down to 60% or less of the contact reaction force PL.

$$90°>\delta L\geqq 67.5° \tag{10}$$

Also, when the following conditional expression (5a) is satisfied, it is possible to keep the insertion force F down to 50% or less of the contact reaction force PL. Based on the conditional expression (5a), the following relational expressions (6a) to (8a) can be obtained, which correspond to the above-mentioned relational expressions (6) to (8), respectively.

$$0<F\leqq 0.5PL \tag{5a}$$

$$0<(\mu+\tan\phi L)/(1-\mu\cdot\tan\phi L)\leqq 0.6 \tag{6a}$$

$$0<\tan\phi L\leqq(1-2\mu)/(2+\mu) \tag{7a}$$

$$90°>\delta L\geqq 90°-\tan^{-1}[(1-2\mu)/(2+\mu)] \tag{8a}$$

According to the expression (8a), the two terminals are structured so that when 4 the male tab 3 of the male terminal 4 is inserted into the fitting portion 1 of the female terminal 2 to connect together the two terminals 2, 4, during the interval between a point of initial contact between the male tab and the spring contact and a point just before the insertion force of the male tab reaches its peak value, the contact angle δL of the male tab 3 with respect to the spring contact 6, and the friction coefficient $\mu$ between the surface of the male tab 3 and the surface of the spring contact 6 satisfy the relational expression $90°>\delta L\geqq 90°-\tan^{-1}[(1-2\mu)/(2+\mu)]$.

With this structure, the insertion force F can be kept down to 50% or less of the contact reaction force PL, and the connection reliability of the connector can be sufficiently ensured while further reducing the burden on the operator.

Also, when the friction coefficient $\mu$ is in a range of from about 0.1 to about 0.4 and the lower limit values of the contact angles δL are calculated in accordance with the relational expression (8) to show the resultant values in a graphic form, they can be expressed by a line B shown in FIG. 4. Based on this graphical representation, the following relational expression (9a) can be obtained and, especially, in a case of a friction coefficient $\mu$ of 0.15 or more, the following relational expression (10a) can be obtained:

$$90°>\delta L\geqq 53.74°\times\mu+63.936° \tag{9a}$$

$$90°>L\geqq 71.9° \tag{10a}$$

Accordingly, the two terminals are structured so that when the male tab 3 of the male terminal 4 is inserted into the fitting portion 1 of the female terminal 2 to connect the two terminals 2, 4 together, during the interval between a point of initial contact between the male tab and the spring contact and a point just before the insertion force of the male tab reaches its peak value, the contact angle δL of the male tab 3 with respect to the spring contact 6, and the friction coefficient $\mu$ between the surface of the male tab 3 and the surface of the spring contact 6 satisfy the relational expression (9a), that is, $90°>\delta L\geqq 53.74°\times\mu+63.936°$. With this structure, the insertion force F can be kept down to 50% or less of the contact reaction force PL, and the connection reliability of the connector can be sufficiently ensured while further reducing the burden on the operator.

Further, when the friction coefficient $\mu$ is 0.15 or more, when the male tab 3 of the male terminal 4 is inserted into the fitting portion 1 of the female terminal 2 to connect the two terminals 2, 4 together, during the interval between a point of initial contact between the male tab and the spring contact and a point just before the insertion force of the male tab reaches its peak value, the contact angle δL of the male tab 3 with respect to the spring contact 6 is 71.9° or more. With this structure, the insertion force F can be kept down to 50% or less of the contact reaction force PL.

When the two terminals 2, 4 are connected together, the contact position of the male tab 3 with respect to the spring contact 6 of the female terminal 2 varies sequentially according to the insertion amount of the male tab 3. For example, when the male tab 3 is inserted by a given distance ωh from an initial contact position H shown by a solid line in FIG. 5 into the fitting portion 1 of the female terminal 2, the contact position of the male tab 3 with respect to the spring contact 6 shifts to a position C shown by a broken line in FIG. 5, that is, this contact position C is lowered by a distance ωv from its initial position C'.

Figure 6:
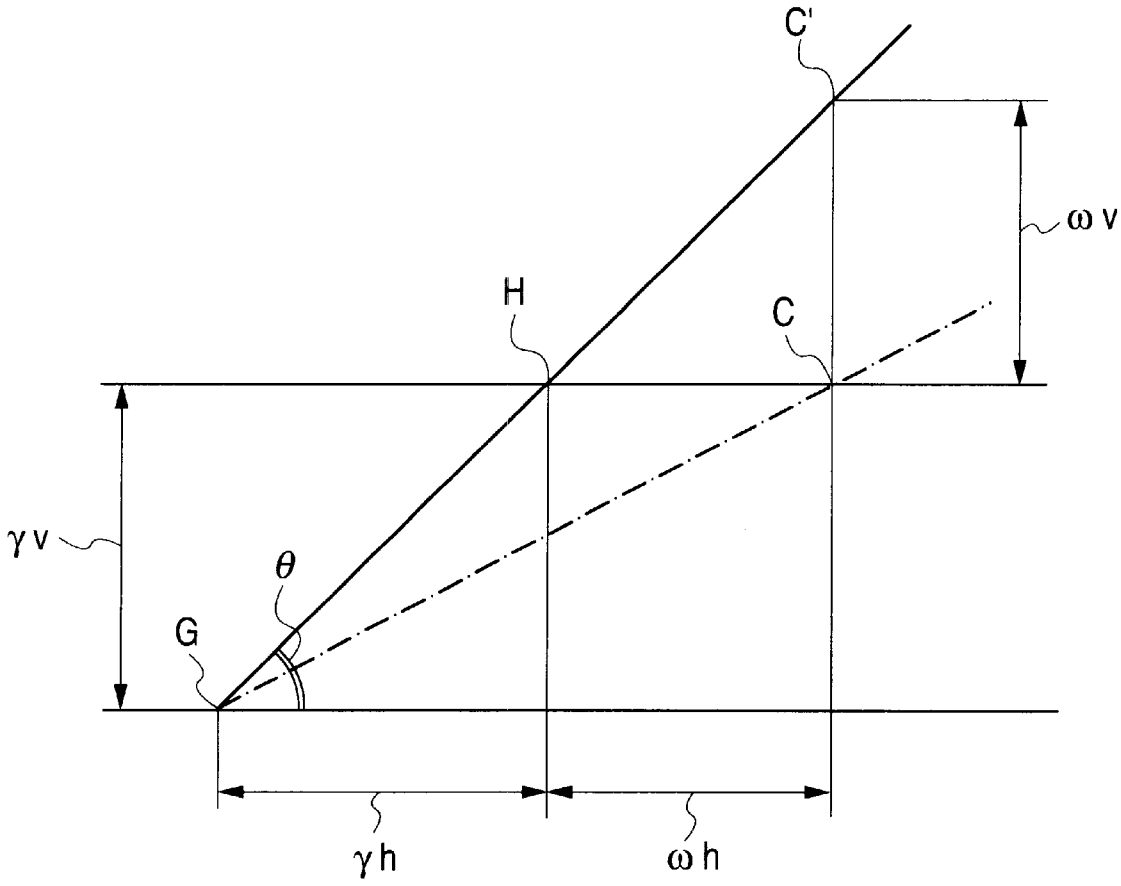
FIG. 6 is an explanatory view of a deforming state of a spring contact.

As shown in FIG. 6, a horizontal distance and a vertical distance from a base end portion G (turned-back end portion) of the spring contact 6 to the initial contact position H of the male tab 3 are expressed as γh and γv, respectively, and the inclination angle of the spring contact 6 with respect to a longitudinal axis of the female terminal 2, in the initial contact state of the male tab 3 with respect to the spring contact 6, is expressed as θ. When the male tab 3 is inserted into the female terminal 2 by a given distance, as the resulting contact position C of the male tab 3 is located at the horizontal distance ωh from the initial contact position H, this contact position C is lowered from its initial position C' by the vertical distance ωv. Accordingly, the following relational expression (11) is satisfied.

$$\tan\theta=\gamma v/\gamma h=(\gamma v+\omega v)/(\gamma h+\omega h)$$

$$\gamma v(\gamma h+\omega h)=\gamma h(\gamma v+\omega v)$$

$$\omega v=\gamma v\cdot\omega h/\gamma h \tag{11}$$

Also, where the second moment of area of the spring contact 6 is expressed as I, the modulus of elasticity is expressed as E, and the load to deform the spring contact 6 elastically, that is, the contact reaction force, is expressed as PL, according to the cantilever deflection curve expression, there can be obtained the following relational expression (12):

$$PL=[3EI/(\gamma h+\omega h)3]\omega v \tag{12}$$

If the relational expression (11) is substituted for the relational expression (12), the following relational expression (13) is obtained. If the relational expression (13) is substituted for the above-mentioned relational expression (4), as shown in the following relational expression (14), a relational expression can be obtained among the insertion force F of the connector, the contact reaction force PL, the insertion position of the male tab 3 (γh+ωh), the inclination angle ωL, and the friction coefficient $\mu$ between the surface of the male tab and the surface of the spring contact.

$$PL=[3EI/(\gamma h+\omega h)3]\gamma v\cdot\omega h/\gamma h \tag{13}$$

$$F=[(\mu+\tan\phi L)/(1-\mu\cdot\tan\phi L)]\cdot[3EI/(\gamma h+\omega h)3]\gamma v\cdot\omega h/\gamma h \tag{14}$$

Figure 7:
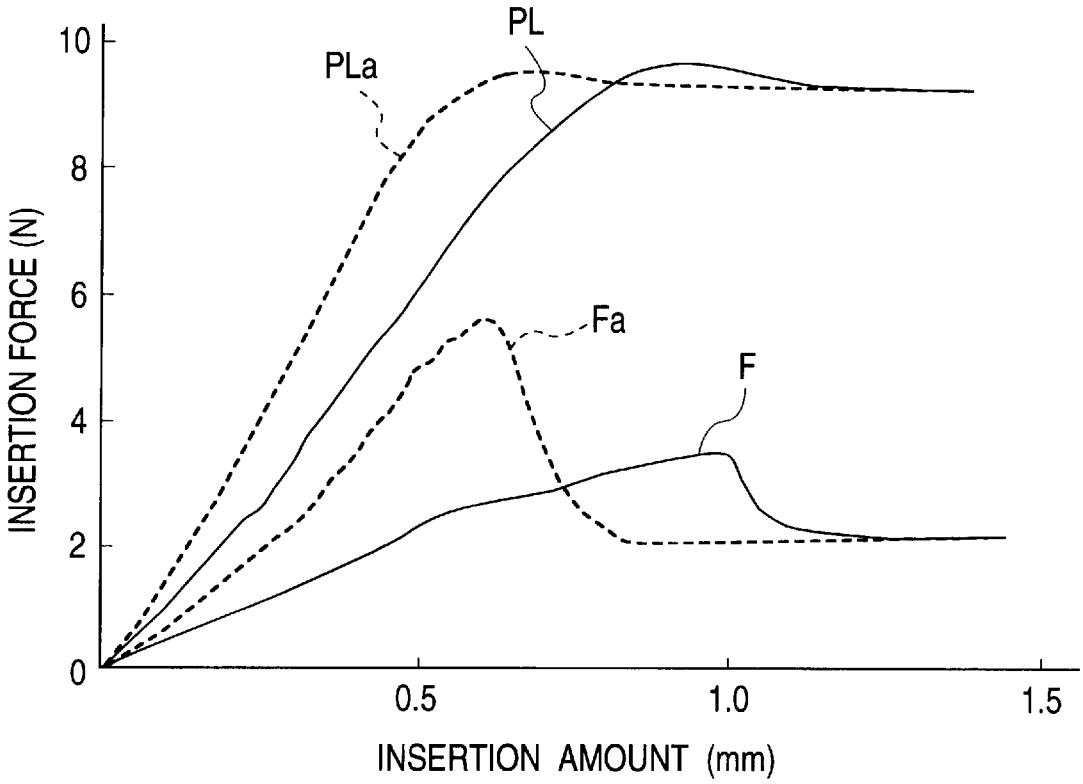
FIG. 7 is a graphical representation of a correspondence between the insertion amount and insertion force of the male tab.

A verification test was performed to compare an embodiment according to the invention, in which the contact angle δL at the initial contact position between the male tab 3 and the spring contact 6 is set at an angle of 76.4°, and the above-described related art example, in which the contact angle is set at an angle of 66.3°. Using the relational expressions (13), (14), it was verified how the insertion forces F (embodiment) and Fa (related art) of the connector and the contact reaction forces PL (embodiment) and PLa (related art) of the spring contact 6 vary according to the insertion amount of the male tab 3. From the verification test, such data as shown in FIG. 7 are obtained. It is noted that in this verification test, the friction coefficient $\mu$ between the surface of the male tab and the surface of the spring contact was set at the order of 0.15 in both the embodiment and the related art, and the contact reaction forces PL (embodiment) and PLa (prior art) in the connection completed state of the connector were each set at the order of 9.3 N.

From the above data, in the related art example, as shown by a broken line in FIG. 7, the peak value of the insertion force Fa is about 5.7. On the other hand, in the embodiment according to the invention, as shown by a solid line in FIG. 7, the insertion force F reaches its peak value of about 3.5 N just before the connector connection is completed. Therefore, as described above, although the contact reaction forces PL (embodiment) and PLa (related art) in the connection-completed state of the connector were set at the same value, respectively, it was confirmed that, in the embodiment according to the invention, the peak value of the insertion force F can be reduced by about 38.6% in comparison with the related art.

Figure 8:
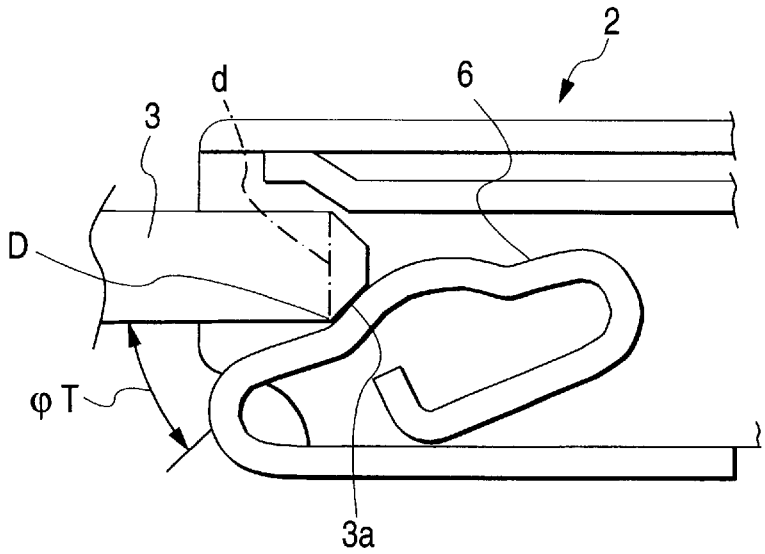
FIG. 8 is an explanatory view of an insertion process of a male tab in another embodiment of a terminal structure of a connector according to the invention.
Figure 9:
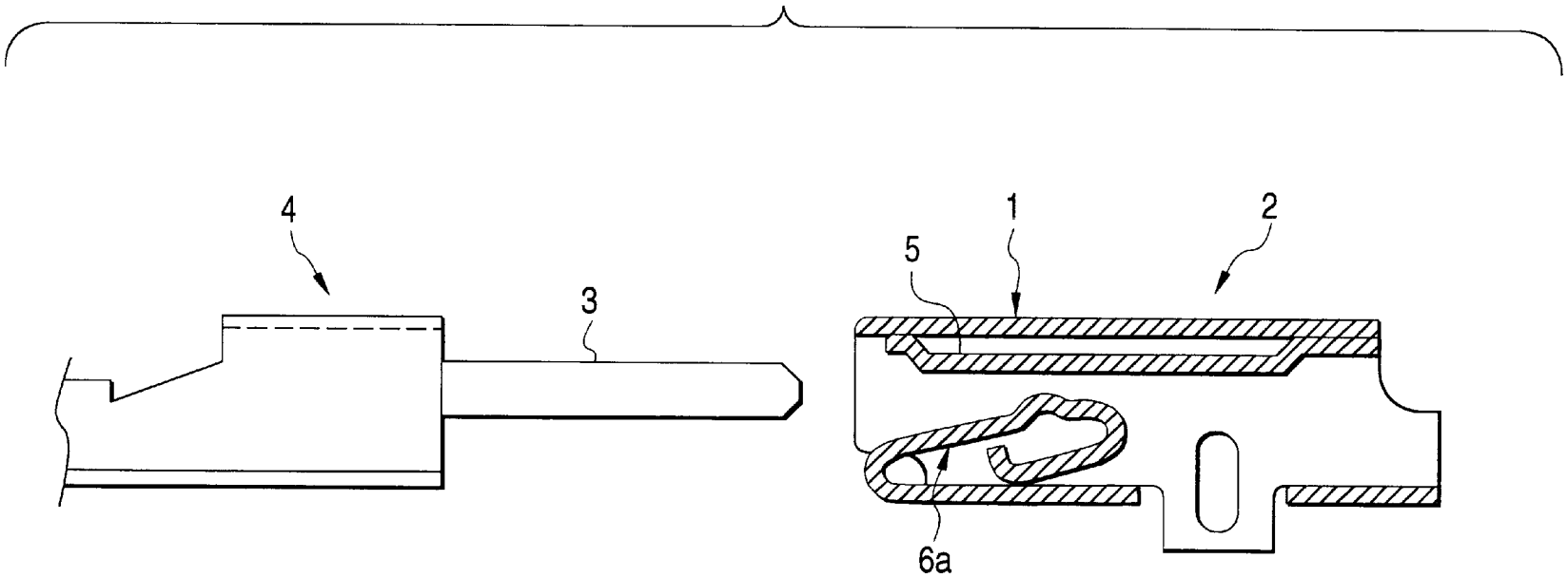
FIG. 9 RELATED ART
FIG. 9 is a side section view of a terminal structure of a connector according to related art.

It is noted that, as shown in FIG. 8, in a connector in which a forwardly-tapered, inclined surface 3*a* is formed at the leading end portion of the male tab 3, when the male tab 3 is inserted into the fitting portion 1 of the female terminal 2, if the inclined surface 3*a* contacts the spring contact 6, the contact angle δL of the male tab 3 is equal to the inclination angle ϕT of the inclined surface 3*a* with respect to a longitudinal axis of the male tab 3.

Accordingly, the connector is structured so that with respect to the inclination angle ϕT of the inclined surface 3*a* formed at the leading end portion of the male tab 3, the angle of 90°−ϕT is set in a range of from about 67.5° to 90°, or in a range of from about 71.9° to 90°, and the inclined surface 3a contacts the spring contact 6 when the male tab 3 is inserted into the fitting portion 1 of the female terminal 2. Thus, during the interval between a point of initial contact between the male tab and the spring contact and a point just before the insertion force of the male tab reaches its peak value, the contact angle δL of the male tab 3 with respect to the spring contact 6 can remain in the range of 90°>δL≧67.5°, or 90°δL≧71.9°.

Figure 5:
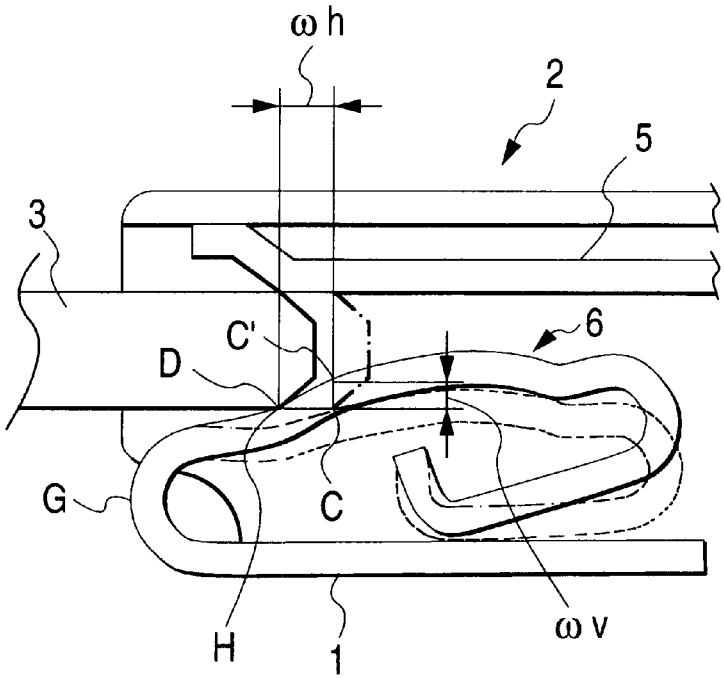
FIG. 5 is an explanatory view of an insertion process of a male tab.

It is noted that the inclination angle ϕT of the inclined surface 3*a* may be set so that the base end portion D of the inclined surface 3*a* is the part that initially contacts the spring contact 6 when the male tab 3 is inserted into the fitting portion 1 of the female terminal 2 (see FIG. 5). By so doing, the contact angle δL at the time of insertion of the male tab 3 with respect to the spring contact 6 of the female terminal 2 is not decided by the inclined surface 3*a*. Thus, the contact angle δL can be set at a proper value according to the set angle of the spring contact 6 and the shape of the contact portion 7. For example, in a case in which the leading end portion of the male tab 3 is formed as a flat surface, as shown by a broken line d in FIG. 8, the leading end portion of the male tab 3 and the spring contact 6 contact each other in a point contact manner and, therefore, the contact angle ϕL is always set in accordance with the inclination angle ϕL of the spring contact 6.

As has been described heretofore, according to the invention, there is provided a terminal structure of a connector, including a female terminal having a spring contact in a fitting portion thereof, and a male terminal having a male tab to be inserted into the fitting portion of the female terminal and contacted by the spring contact. When the male tab is fitted into the fitting portion of the female terminal, during the interval between a point of initial contact between the male tab and the spring contact and a point just before the insertion force of the male tab reaches its peak value, the contact angle δL of the male tab with respect to the spring contact, and the friction coefficient $\mu$ between the surface of the male tab and the surface of the spring contact satisfy the following relational expression:

$$90°>\delta L\geqq 90°-\tan^{-1}[(3-5\mu)/(5+3\mu)].$$

By so doing, when the male tab is fitted into the fitting portion of the female terminal to connect the male and female terminals together, the contact reaction force of the spring contact can be set at a sufficiently high value, while preventing the insertion force of the male tab from suddenly increasing to its peak value. Accordingly, using a simple structure, the connecting operation of the two terminals can be carried out easily and, at the same time, a sufficient contact pressure can be ensured between the male tab and spring contact to thereby be able to enhance the connection reliability of the connector.

While the invention has been described in conjunction with the specific embodiments described above, many equivalent alternatives, modifications and variations may become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

What is claimed is:

1. A terminal structure of a connector, comprising:

a female terminal having a spring contact in a fitting portion thereof; and a male terminal having a male tab to be inserted into the fitting portion of the female terminal and contacted by the spring contact, wherein when the male tab is fitted into the fitting portion of the female terminal, during the interval between a point of initial contact between the male tab and the spring contact and a point just before an insertion force of the male tab reaches a peak value, a contact angle δL of the male tab with respect to the spring contact, and a friction coefficient $\mu$ between a surface of the male tab and a surface of the spring contact satisfy the following relational expression:

$$90°>\delta L\geqq 90°-\tan^{-1}[(3-5\mu)/(5+3\mu)].$$

2. The terminal structure according to claim 1, wherein during the interval 4 between the point of initial contact between the male tab and the spring contact and the point just before the insertion force of the male tab reaches the peak value, the contact angle δL of the male tab with respect to the spring contact, and the friction coefficient $\mu$ between the surface of the male tab and the surface of the spring contact satisfy the following relational expression:

$$90° > \delta L \geqq 53.74° \times \mu 59.537°.$$

3. The terminal structure according to claim 1, wherein during the interval between the point of initial contact between the male tab and the spring contact and the point just before the insertion force of the male tab reaches the peak value, the contact angle δL of the male tab with respect to the spring contact is in a range of 90°>δL≧67.5°.

4. The terminal structure according to claim 1, wherein during the interval between the point of initial contact between the male tab and the spring contact and the point just before the insertion force of the male tab reaches the peak value, the contact angle δL of the male tab with respect to the spring contact, and the friction coefficient i between the surface of the male tab and the surface of the spring contact satisfy the following relational expression:

$$90° > \delta L \geqq 90° - \tan^{-1}[(1-2\mu)/(2+\mu)].$$

5. The terminal structure according to claim 4, wherein during the interval between the point of initial contact between the male tab and the spring contact and the point just before the insertion force of the male tab reaches the peak value, the contact angle δL of the male tab with respect to the spring contact, and the friction coefficient $\mu$ between the surface of the male tab and the surface of the spring contact satisfy the following relational expression:

$$90° > \delta L \geqq 53.74° \times \mu + 63.936°.$$

6. The terminal structure according to claim 4, wherein during the interval between the point of initial contact between the male tab and the spring contact and the point just before the insertion force of the male tab reaches the peak value, the contact angle δL of the male tab with respect to the spring contact is in a range of 90°>δL≧71.9°.

7. The terminal structure according to claim 1, wherein a forwardly-tapered inclined surface is formed at a leading end portion of the male tab.

8. The terminal structure according to claim 7, wherein when the male tab is fitted into the fitting portion of the female terminal, an initial contact between the male tab and the spring contact is a contact between a base end portion of the inclined surface and the spring contact.

9. The terminal structure according to claim 7, wherein when the male tab is fitted into the fitting portion of the female terminal, an initial contact between the male tab and the spring contact is a contact between the inclined surface and the spring contact.

* * * * *